United States Patent [19]

Daeschner

[11] Patent Number: 4,807,517

[45] Date of Patent: Feb. 28, 1989

[54] ELECTRO-HYDRAULIC PROPORTIONAL ACTUATOR

[75] Inventor: John Daeschner, Torrance, Calif.

[73] Assignee: Allied-Signal Inc., Morristown, N.J.

[21] Appl. No.: 430,212

[22] Filed: Sep. 30, 1982

[51] Int. Cl.[4] ..... F15B 9/10

[52] U.S. Cl. ..... 91/384; 91/415; 91/464

[58] Field of Search ..... 91/384, 415, 464; 137/625.69

[56] References Cited

U.S. PATENT DOCUMENTS 2,414,451 1/1947 Christensen ..... 137/625.69
2,637,341 5/1953 Borst ..... 91/464
2,917,026 12/1959 Hall et al. ..... 91/384
4,044,652 8/1977 Lewis et al. ..... 91/368

FOREIGN PATENT DOCUMENTS 2045410 9/1970 Fed. Rep. of Germany ..... 91/415

*Primary Examiner*—Robert E. Garrett
*Attorney, Agent, or Firm*—Ken C. Decker

[57] ABSTRACT

An electro-hydraulic proportional servoactuator is disclosed which has built-in fail-safe systems which cause the power turbine nozzles to return to a zero degree angular position in the event of either an electrical system failure or a hydraulic system failure, and features a toggling effect.

14 Claims, 5 Drawing Sheets

ELECTRO-HYDRAULIC PROPORTIONAL ACTUATOR

BACKGROUND OF THE INVENTION

The use of gas turbine engines in automotive and other ground transportation applications necessitates control devices and designs differing from those used with gas turbine aircraft engines, since a gas turbine engine used in ground transportation vehicles must operate under a unique set of conditions and with a type of response constituting an analog of the traditional piston engine-powered vehicle performance. In particular, one of the control functions important to the operation of a ground transportation gas turbine engine is the positioning of the power turbine nozzles, which are adjusted to vary the speed of the turbine output.

The input electrical signal is produced by a preprogrammed control computer operating in response to various control and condition parameters such as accelerator pedal position, ambient temperature, ambient pressure, gas generator speed, gas generator turbine temperature, regenerator "hot side temperature", and transmission output shaft velocity. A servoactuator device is utilized to produce an output motion in proportion to the input electrical control signal.

The output motion of the servoactuator device acts through a suitable linkage mechanism to drive a ring gear, which in turn rotates the power turbine nozzles through the desired angular travel. Particular angular settings of the nozzles are specified during acceleration, deceleration, start-up, and steady-state operation of the gas turbine engine. The nozzles may be positioned in a braking mode by the servoactuator device so that some degree of braking of the vehicle is attained from the gas turbine engine.

Computer control systems to operate the system in accordance with the signals provided by the various sensors are known in the art, and do not comprise any portion of the present invention. The main difficulty in developing a satisfactory control system for use with ground transportation gas turbine engines has been in designing a suitable servoactuator device to control the nozzle position. The most practical servoactuator device to date is described in U.S. Pat. No. 4,044,652, assigned to the assignee of the present invention, and that patent is hereby incorporated herein by reference. The device disclosed therein is a hydraulic motor having an output shaft for coupling to the ring gear to position the turbine nozzle. Movement of the hydraulic motor is controlled by a hydraulic servo valve actuated by a proportional solenoid. Since motion of the hydraulic motor piston causes a corresponding translation of the solenoid and valve, mechanical feedback obtained therein linearizes the response function to eliminate the need for closed loop operation of the system in which the servoactuator is used.

Although the servoactuator device disclosed in U.S. Pat. No. 4,044,652 provides some significant advantages over other servoactuator devices known, it has, like these other devices, a number of significant problems. One of these problems stems from the desirability of obtaining a deceleration mode in which the servoactuator causes the nozzles to be reversed to cause the turbine engine to produce a braking effect upon the vehicle. To attain a braking mode in devices such as that disclosed in the above-referenced U.S. patent, it is necessary to operate the servoactuator so that it will be positioned in the reverse mode when the input electrical control signal provided to the servoactuator is at zero. As the input electrical control signal increases, the servoactuator will operate to move the nozzles to the zero degree angular position, and then to a positive angular position.

The result of this type of operation is that in order to position the nozzles in the zero degree angular position, the electrical control signal must be at a significant portion of its maximum value, such as one-half of maximum value. During operation of the turbine in the forward mode, in order to reverse the nozzles and position them in the braking mode, that is, in a negative angular position, the electrical control signal must be changed from a value greater than half of the maximum control signal to a level very near to a zero signal. It would be more advantageous to have a servoactuator which was at the zero degree angular position when the electrical control signal was also at a zero level, the angular position increasing in a positive manner as the electrical control signal was increased.

In addition, instead of operating the braking mode in the manner just described, it would be desirable to provide the servoactuator device with a toggling action, so that when the electrical control signal reaches a certain predetermined positive value, the servoactuator will immediately position the nozzles in the negative angular position, thus causing dynamic braking of the vehicle. In order to attain such operation from the device described in the above-referenced U.S. patent, a dump valve would have to be installed in the system; such a valve may give some degree of toggling effect, but at the price of an additional component which increases the cost, weight, and space requirements of the control system. Therefore, a servoactuator device which incorporates the toggling effect without the requirement of the additional components is highly desirable.

Servoactuator devices presently existing all share another major problem-adverse consequences in the operation of the servoactuator following either an electrical failure or a hydraulic failure in the control system. In the event of either type of failure, it is highly desirable that the servoactuator cause the nozzles to be positioned in the zero degree angular position to prevent the turbine engine from being damaged or placed in a runaway mode.

In the event of an electrical failure, the system described above will cause the nozzles to be placed in the full negative angular position to cause dynamic braking of the vehicle. Depending on the condition the turbine engine was operating in when the electrical failure occurred, such a failure could have catastrophic results, possibly resulting in the destruction of the turbine engine. Even should the result be less severe, there would be a tendency for the nozzles to direct the gas in a way tending to impart a reverse velocity to the power turbine, a highly undesirable effect.

The effects of the hydraulic failure are equally dissettling, since with a loss of hydraulic pressure the servoactuator will tend to stay in the position it was in when the failure occurred. Therefore, if the turbine engine was being operated in an acceleration mode at the time of hydraulic failure, the nozzles will remain in the acceleration position, possibly causing a runaway condition to occur in the turbine engine. Therefore, it can be seen that it is desirable in the event of either an electrical failure or a hydraulic failure, for the servoactuator to operate in a failure mode in which the nozzles are positioned in the zero degree angular setting.

SUMMARY OF THE INVENTION

The present invention comprises a servoactuator device and method of using the device to position the power turbine nozzles for applications such as in a ground-transportation gas turbine engine, the servoactuator having built-in fail-safe systems to cause the power turbine nozzles to be returned to a zero degree angular setting in the case of either an electrical failure or a hydraulic failure in the control system. The servoactuator may be used to reverse the nozzles to attain dynamic braking by providing to the servoactuator an electrical control signal having a preselected threshhold value; when the electrical control signal reaches this preselected threshhold value, the servoactuator will toggle to the full reverse position to position the nozzles of the power turbine in the full negative angular position.

The servoactuator is driven by a two-sided piston contained in a hydraulic cylinder. The hydraulic cylinder may be supplied with pressurized fluid from either end, and thus, the piston may be driven in either direction. The surface area of the piston upon which the hydraulic fluid will act is greater on one side than on the other, so if hydraulic pressure is supplied to both sides of the piston, the resulting force differential will drive the piston from the side of the piston with the greater surface area.

The two sides of the piston are supplied with hydraulic fluid through a spool valve arrangement, which is actuated by a proportional solenoid. In the preferred embodiment, a single hydraulic fluid source is used, along with dual hydraulic fluid vents. Force feedback is provided by a mechanical linkage in which the piston displacement is used to provide negative feedback to the spool valve.

By supplying an electrical control signal varying from zero to a preselected threshold value, the servoactuator is caused to be driven from a zero degree angular setting to the maximum positive angular position. An increase in the electrical control signal over the preselected threshold value will cause the servoactuator to toggle to the full negative angular position, in which position it will remain until the control signal drops to a second preselected value which is below the preselected threshold value. In this way, the servoactuator will toggle to the full negative angular position without the necessity for a dump valve or any other type of additional hardware.

A pair of springs are located in the hydraulic cylinder, and are of sufficient force to return the piston to a zero degree angular position in the absence of hydraulic pressure in either side of the cylinder. In the absence of any electrical control signal being supplied to the solenoid coil, the spool valve will return to a position allowing hydraulic fluid to be vented from both sides of the cylinder, thus removing hydraulic pressure from the cylinder. Therefore, it can be seen that in the event of either a hydraulic failure or an electrical failure, the piston will be caused by the biasing springs to return to the zero degree angular setting, preventing either a runaway condition or a full reverse thrust condition from occurring in the operation of the turbine.

DESCRIPTION OF THE DRAWINGS

These and other advantages of the present invention are best understood through reference to the drawings, in which.

DESCRIPTION OF THE PREFERRED EMBODIMENT

Figure 1:
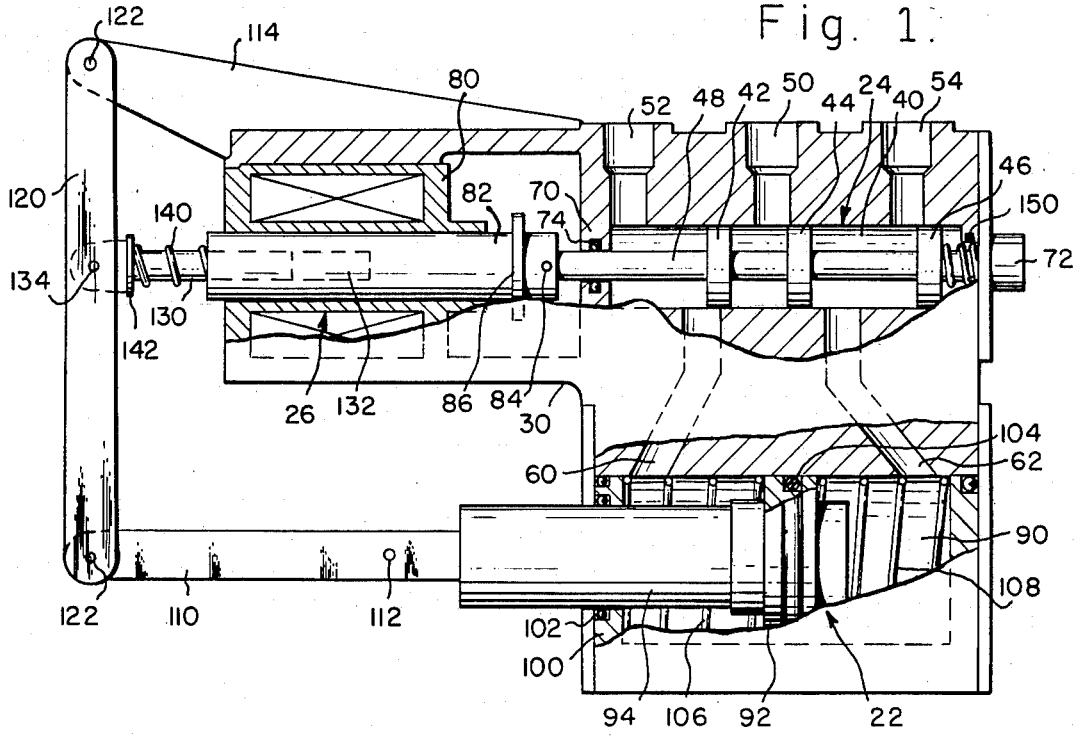
FIG. 1 is a front elevation view of the electrohydraulic proportional servoactuator with a zero electrical control signal being supplied to the device.

FIG. 1 shows an electro-hydraulic proportional servoactuator 20 in accordance with the present invention. The servoactuator 20 comprises four basic elements: a hydraulic cylinder, indicated generally at 22, a spool valve, indicated generally at 24, a solenoid for driving the spool valve 24, indicated generally at 26, and a force feedback mechanism connecting the hydraulic cylinder 22 and the solenoid 26, indicated generally at 28. The hydraulic cylinder 22, the spool valve 24, and the solenoid 26 are contained in an actuator body 30.

The spool valve 24 consists of a cylindrical chamber 40 having a number of hydraulic fluid passages entering and leaving the chamber 40, and of three valve discs 42, 44, and 46 fixedly mounted on a spool rod 48. Specifically, there is a plus valve disc 42, an inlet valve disc 44, and a minus valve disc 46 fixedly mounted on the spool rod 48.

Hydraulic fluid is supplied to the actuator 20 through a fluid inlet 50 leading into the spool valve 24, and leaves the actuator 20 through two fluid outlets 52, 54, which are located at opposite ends of the spool valve 24. The flow of hydraulic fluid controlled by the spool valve 24 will flow to the left side of the hydraulic cylinder 22 through the plus fluid line 60, into the right side of the cylinder 22 through the minus fluid line 62.

The spool rod 48 and the three valve discs 42, 44, and 46 are movable longitudinally within the valve chamber 40, and the spool rod 48 is supported by an aperture in the wall 70 of the actuator body 30 on one end, and by a shaft end cap 72 on the other end, An O-ring 74 is installed in the wall 70 to prevent hydraulic fluid from leaking from the valve chamber 40 to the solenoid 26.

The solenoid 26 is supported at the left side of the actuator body 30, and comprises a solenoid coil 80 and a solenoid plunger 82. The plunger 82 moves longitudinally within the solenoid coil 80, and is connected to drive the spool rod 48 by a pin 84. As the solenoid coil 80 is energized, it will tend to draw the plunger 82 into the solenoid coil 80, or to the left in FIG. 1. The force with which the plunger 82 is drawn into the solenoid coil 80 is directly proportional to the magnitude of the electrical control signal which is supplied to the solenoid coil 80. The movement of the solenoid plunger 82 will be restricted by a plunger stop 86 on the plunger 82 when the plunger stop 86 makes contact with the solenoid coil 80. Movement of the solenoid plunger 82 and the spool rod 48 caused by current in the solenoid coil 80 is biased against by the use of two springs which will be discussed below along with the force feedback mechanism 28.

The hydraulic cylinder 22 is comprised of a cylinder 90, a piston 92, and a piston shaft 94. The piston shaft 94 is fixedly attached to and extends from one side of the piston 92, the left side of the piston 92 in FIG. 1. The piston shaft 94, which extends through an aperture in the wall 100 of the actuator body 30, and an O-ring 102 to prevent hydraulic fluid from leaking from the cylinder 90, is of a diameter smaller than the diameter of the piston 92.

An O-ring 104 extends around the circumference of the piston 92 to prevent hydraulic fluid in the cylinder 90 from moving from one side of the piston 92 to the other side of the piston 92. Therefore, it can be seen that when hydraulic fluid is admitted to the cylinder 90 through the plus fluid line 60, hydraulic pressure will tend to force the piston to move from left to right in the cylinder 90. Likewise, if hydraulic fluid is admitted to the cylinder 90 through the minus fluid line 62, the hydraulic pressure will tend to force the piston 92 to move in a direction from right to left in the cylinder 90.

Since on the left side of the piston 92 the piston shaft 94 extends from the surface of the piston through the wall 100, the effective working area of the piston 92 on the left side is reduced by the cross-sectional area of the piston shaft 94. Therefore, since the working area of the piston 92 on the right side is greater than the working area of the piston 92 on the left side, if hydraulic fluid is admitted to the cylinder 90 through both the plus fluid line 60 and the minus fluid line 62, the resulting force will tend to move the piston 92 in a direction from right to left in the cylinder 90.

Since it is desirable to have the piston 92 remain in a central position in the cylinder 90 in the absence of hydraulic pressure from either the plus fluid line 60 or the minus fluid line 62, a pair of springs 106, 108 are used to bias the piston 92 into this central position in the cylinder 90. A plus piston spring 106 is located in the cylinder 90 on the left side of the piston 92, and tends to force the piston 92 from left to right in the cylinder 90. A minus piston spring 108 is located in the cylinder 90 on the right side of the piston 92, and tends to exert a force impelling the piston 92 from right to left in the cylinder 90. The springs 106, 108 are sized so that they exert a force sufficiently large to overcome the greatest expected friction, so that the piston 92 will always be returned to the central position in the cylinder 90 in the absence of hydraulic pressure from either the plus fluid line 60 or the minus fluid line 62. Of course, the springs 106, 108 must also be sized so that they are not large enough to prevent the piston 92 from being operated by hydraulic pressure from the plus fluid line 60 or the minus fluid line 62.

Therefore, in the event of a hydraulic system failure in which there is hydraulic pressure in neither the plus fluid line 60 or the minus fluid line 62, the springs 106, 108 will return the piston 92 to the central position in the cylinder 90. This central position corresponds to the zero degree angular position of the power turbine nozzles, since the movement of the piston 92 in the cylinder 90 is used to cause movement of the power turbine nozzles.

The hydraulic cylinder 22 is linked to the solenoid 26 and the spool valve 24 by the force feedback mechanism 28. An output arm 110 extends from the piston shaft 94. This output arm has one or more locations at which appropriate mechanical linkage may be installed to drive the power turbine nozzles. Such linkage is well known and standard in the art, and may be connected to the coupling point 112 shown in FIG. 1.

A pivot arm 114 extends from the top of the actuator body 30 and over the end of the solenoid 26. On the pivot arm 114 a lever arm 120 is rotatably mounted with a pin 122. A second pin 124 is used to connect the end of the lever arm 120 not connected to the pivot arm 114 to the output arm 110. Thus, it can be seen that movement of the piston 92 in the cylinder 90 will cause a corresponding translation of the lever arm 120 around its mounting point on the pivot arm 114.

A sliding link rod 130 moves in a longitudinal direction freely within a plunger cavity 132 located in the solenoid plunger 82 on the end of the solenoid plunger 82 extending to the left of the solenoid coil 80 in FIG. 1. The sliding link rod 130 is then rotatably attached to the lever arm 122 by a pin 134. Movement of the piston 92 in the cylinder 90 will thus cause a corresponding longitudinal movement of the sliding link rod 130 in the plunger cavity 132.

A compression spring 140 is located on the sliding link rod 130, and the left side of the spring 140 abuts a spring stop 142 on the sliding link rod 130. The right side of the spring 140 abuts the solenoid plunger 82, and since the spring 140 is installed under compression, it tends to urge the solenoid plunger 82 to the right. Therefore, it can be seen that the compression spring 140 exerts a force which will oppose the magnetic pull of the solenoid coil 80 on the solenoid plunger 92, so that when the electrical control signal to the solenoid coil is zero, the spring 140 will cause the solenoid plunger 82 and the spool rod 48 to move to the right.

In the preferred embodiment, a small spring 150 is located on the right end of the spool rod 48, and will urge the spool rod 48 and the solenoid plunger 82 to the left. However, the force exerted by the spring 150 is substantially smaller than force exerted by the spring 140, so when electrical control signal to the solenoid coil 80 is zero, the solenoid plunger 82, the spool rod 48, and the valve discs 42, 44, and 46 will be urged to the position in which they are shown in FIG. 1.

Since the position of the valve discs 42, 44, and 46 as shown in FIG. 1 allow no hydraulic fluid to pass from the fluid inlet 50 to either of the fluid lines 60, 62, and since the plus fluid line 60 may drain to the fluid outlet 52, and the minus fluid line 62 may drain to the fluid outlet 54, it is apparent that in the event of an electrical failure there will be no hydraulic pressure in either the plus fluid line 60 or the minus fluid line 62. Therefore, the piston springs 106, 108 will urge the piston 92 to the central position in the cylinder 90, causing the power turbine nozzles to remain in a zero degree angular setting in the event of an electrical failure.

OPERATION OF THE DEVICE

The actuator 20 as described above and shown in FIG. 1 is depicted under conditions in which there is a zero electrical control signal supplied to the solenoid coil 80. The conditions present in FIG. 1 correspond to the point A on the steady-state plot of the actuator 20 response shown in FIG. 10. It is important to note that the plot of FIG. 10 is one of steady-state performance, and represents the various positions of the device after the device has reached equilibrium for any particular electrical control signal input to the solenoid coil 80.

Figure 2:
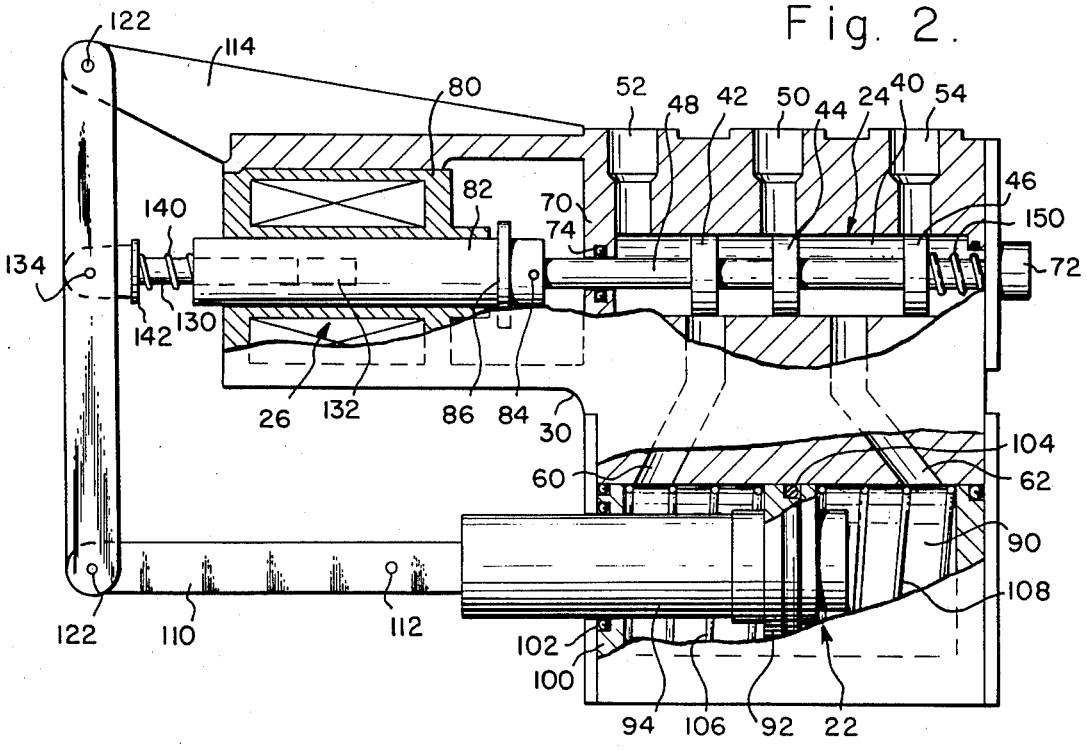
FIG. 2 is a similar view of the device of FIG. 1, at the instant the electrical control signal supplied to the device increases from zero to a value less than the predetermined threshhold value.
Figure 10:
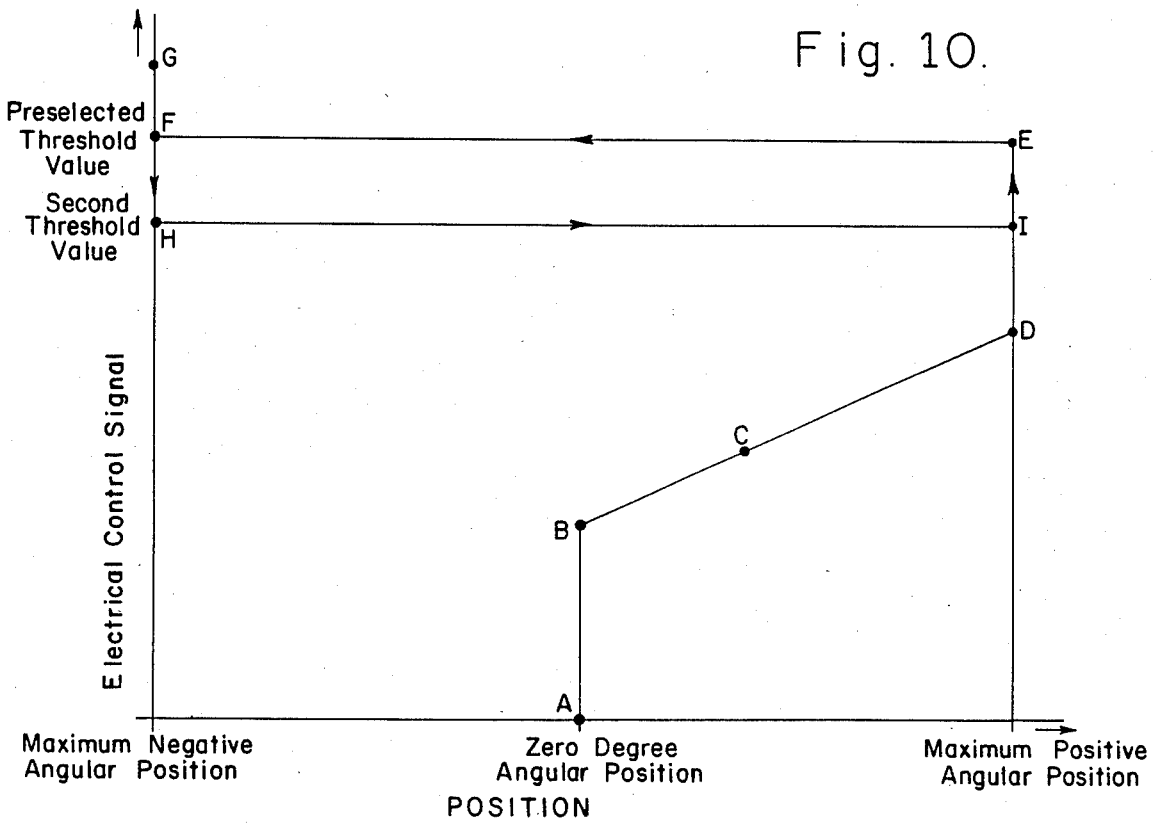
FIG. 10 is a plot depicting the output of the device shown in FIGS. 1–9 for various levels of the electrical control signal.

In FIG. 2, the actuator 20 is shown with an electrical control signal slightly greater than the current shown at point B in FIG. 10 being supplied to the solenoid coil 80. This electrical control signal will cause the solenoid plunger 82 to be drawn into the solenoid coil 80, moving with it the spool rod 48 and the attached valve discs 42, 44, and 46 into the position shown in FIG. 2. At this instantaneous point in time, hydraulic pressure will be supplied from the fluid inlet 50 into the valve chamber 40 past the inlet valve disc 44, and into the plus fluid line 60 past the plus valve disc 42.

Figure 3:
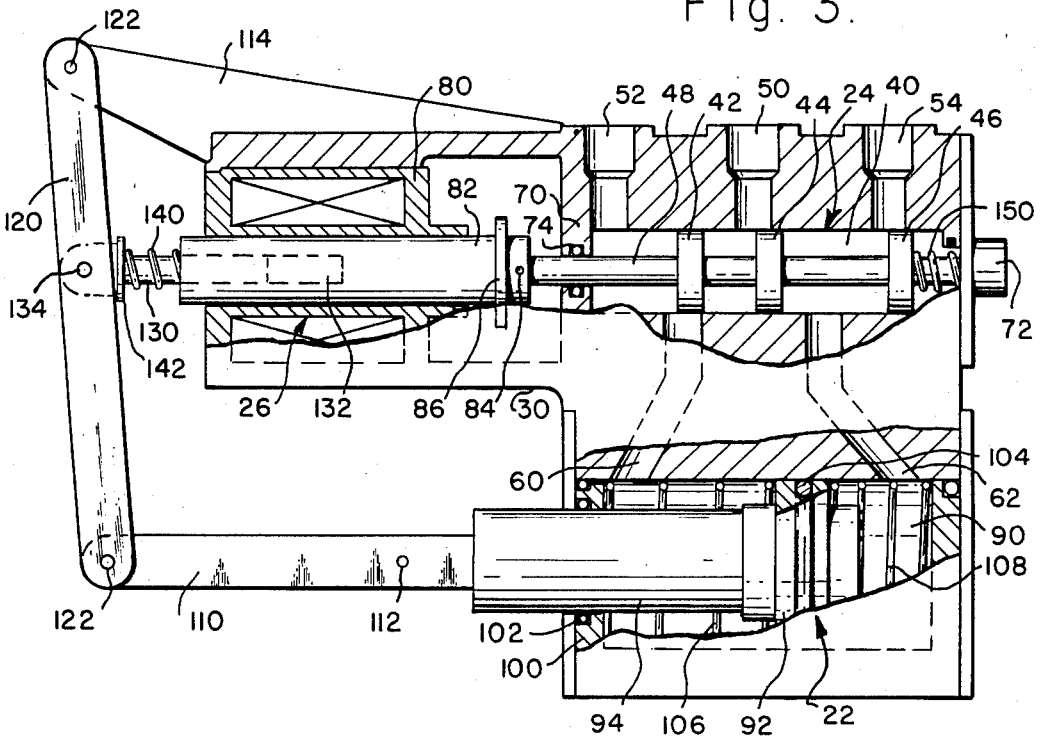
FIG. 3 is a similar view of the device of FIG. 1, at a point at which the device has reached equilibrium for the electrical control signal supplied in FIG. 2.

This hydraulic fluid pressure will be placed on the left side of the piston 92, causing it to move to the right to the position shown in FIG. 3, which corresponds to the point C on the plot in FIG. 10. As the piston 92 moves to the right, the force feedback mechanism 28 causes the sliding link rod 130 to also move to the right, causing a further compression of the spring 140 to occur, which will return the solenoid plunger 82 and the spool rod 48 slightly to the right. At the point at which the plus valve disc 42 begins to obstruct the opening from the valve chamber 40 to the plus fluid line 60, the hydraulic pressure will begin to diminish, causing the piston 92 to stop its rightward movement. At this point, the equilibrium position depicted in FIG. 3 is reached, and the piston 92 will remain in this position until the electrical control signal supplied to the solenoid coil 80 is either increased or decreased.

Figure 4:
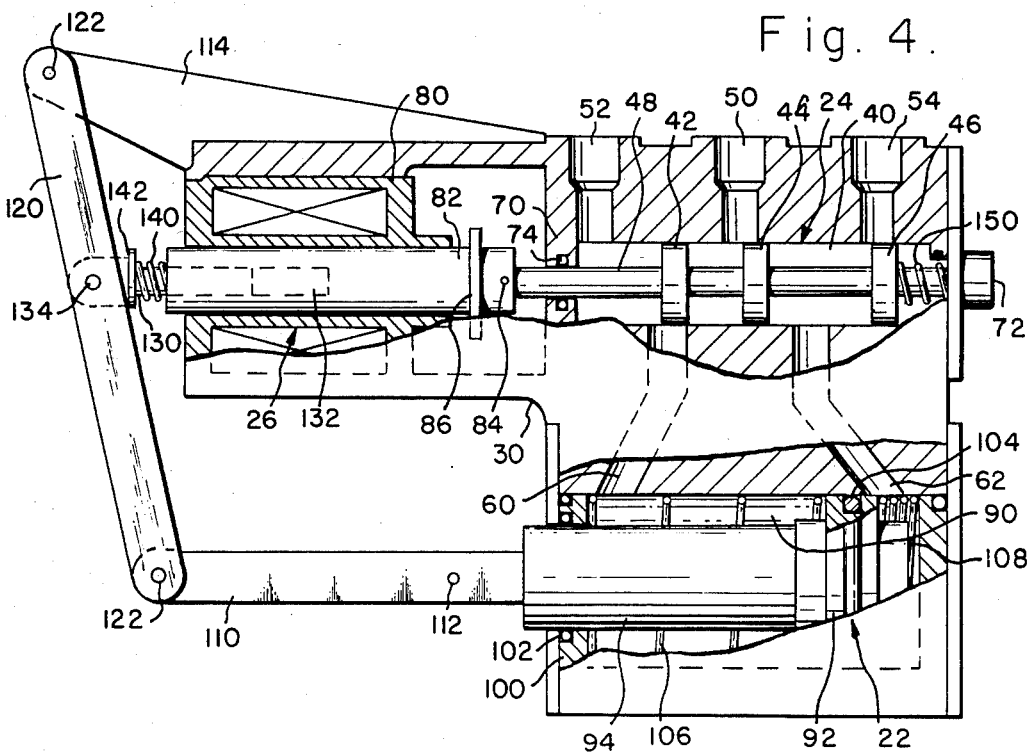
FIG. 4 is a similar view of the device of FIG. 1, in which the device has reached the maximum positive angular position.
Figure 5:
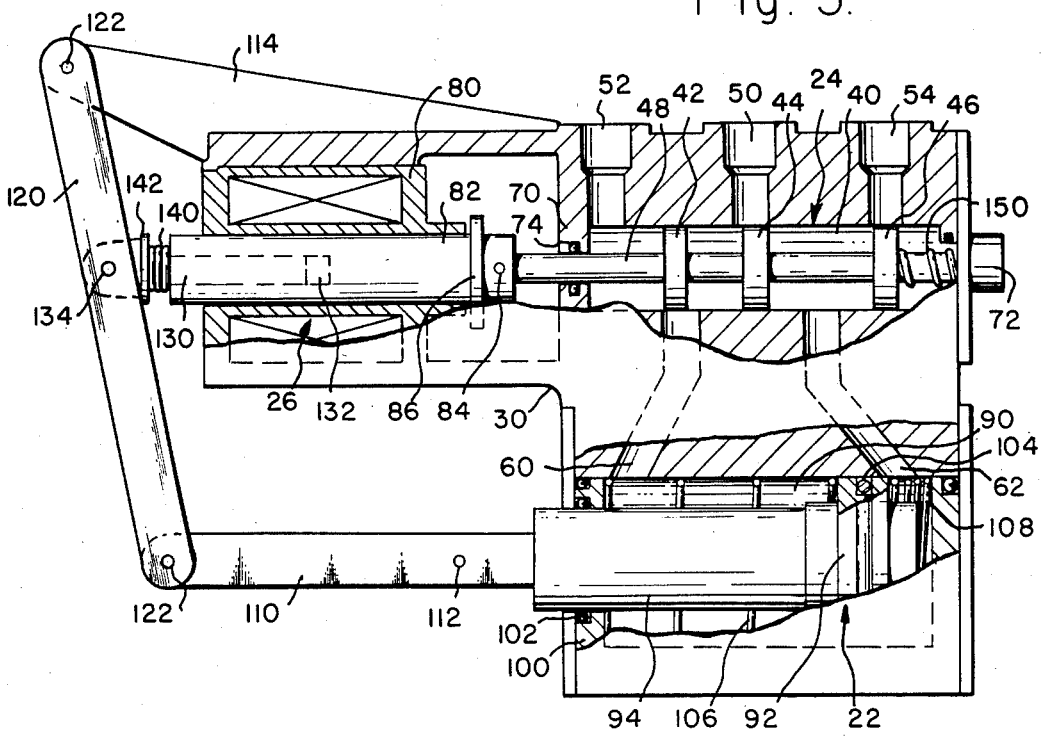
FIG. 5 is a similar view of the device of FIG. 1, in which the electrical control signal has reached a value just below the preselected threshold value, for which the device remains in the maximum positive angular position.

FIG. 4 depicts the conditions in the actuator 20 corresponding to the point D on the plot in FIG. 10. The piston has reached its rightmost position, which corresponds to the power turbine nozzles being placed in their maximum positive angular setting. A further increase in the electrical control signal supplied to the solenoid coil 80 corresponding to movement from the point D to a level slightly below the point E on the plot in FIG. 10 will cause conditions in the actuator 20 to be as shown in FIG. 5. This piston 92 is in the rightmost position, and the inlet valve disc 44, if moved to the left any more, will allow hydraulic fluid to flow from the fluid inlet 50 to the minus fluid line 62, as well as to the plus fluid line 60.

Figure 6:
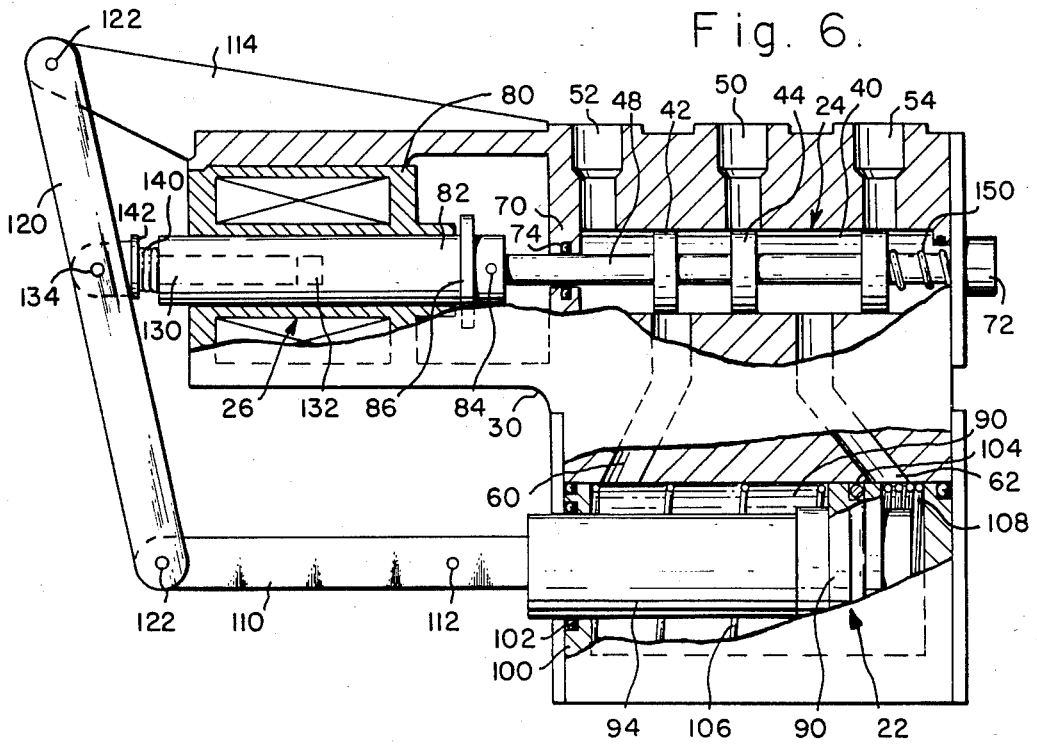
FIG. 6 is a similar view of the device of FIG. 1, at the instant at which the electrical control signal reaches the preselected threshold value.

In FIG. 6, the electrical control signal supplied to the solenoid coil 80 has increased at that instant to the level depicted by the point E on the plot in FIG. 10. At this point, it can be seen that hydraulic fluid will, in fact, flow from the fluid inlet 50 into the valve chamber 40 on both sides of the inlet valve disc 44, and then into both the plus fluid line 60 and the minus fluid line 62. Under such conditions, at the instant the device is depicted at in FIG. 6, the force on the right side of the piston 92 will be greater than the force on the left side of the piston 92, since the hydraulic fluid is acting on the greater area present on the right side of the piston 92.

Figure 7:
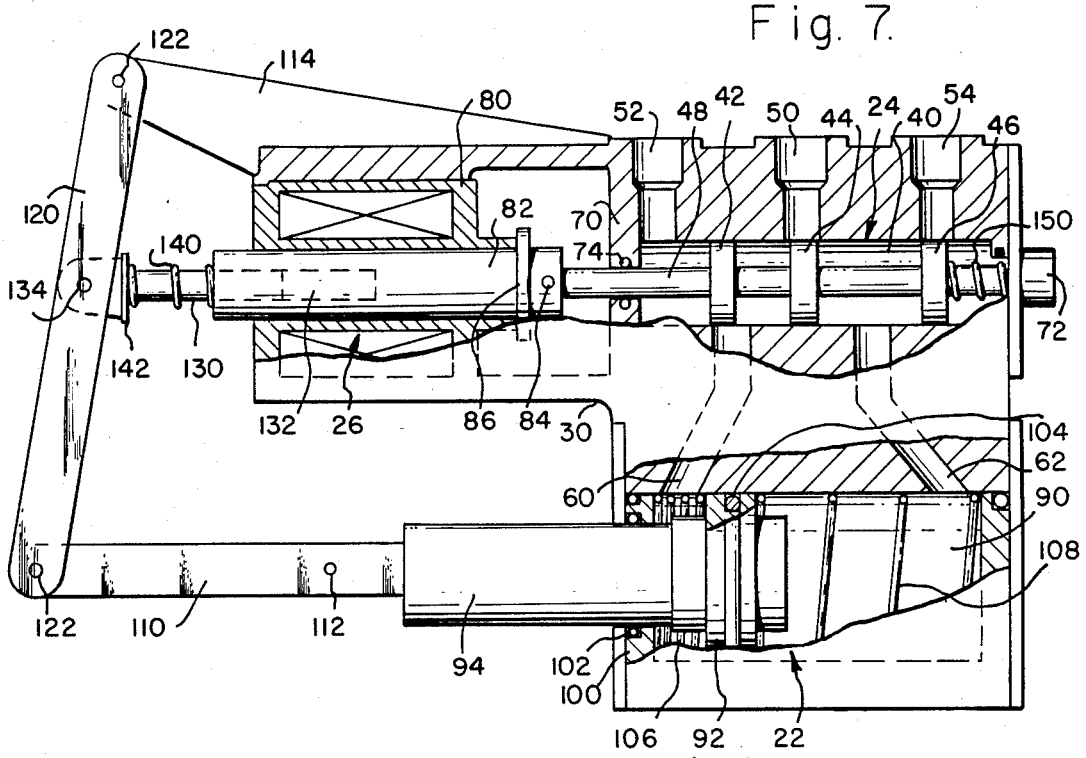
FIG. 7 is a similar view of the device of FIG. 1, illustrating the toggling of the device to the full negative angular position, which is the equilibrium position for the electrical control signal supplied in FIG. 6.

This force will make the piston 92 move to the left, to the position shown in FIG. 7, which corresponds to the point F on the plot in FIG. 10. It is important to note that when the electrical control signal reaches the level at the point E shown on the plot in FIG. 10, the position of the piston 92 will immediately move to that shown by the point F, since the electrical control signal supplied at the point E is the preselected threshhold value at which the device will toggle. This toggling action will, of course, cause the nozzles of the power turbine to be positioned in the full negative angular position.

It is also important to note that in FIG. 7 that when the piston 92 moves to its full leftward position, the amount of pressure exerted by the compression spring 140 on the solenoid plunger 82 will be reduced, causing the solenoid plunger to move to its full leftward position, with the plunger stop 86 resting against the solenoid coil 80. Since the amount of force in the spring 140 urging the solenoid plunger 82 in a rightward direction has been reduced, the electrical control signal supplied to the solenoid coil 80 may be reduced below the level depicted at the point F in FIG. 10 without causing the plunger 92 to change position.

Figure 8:
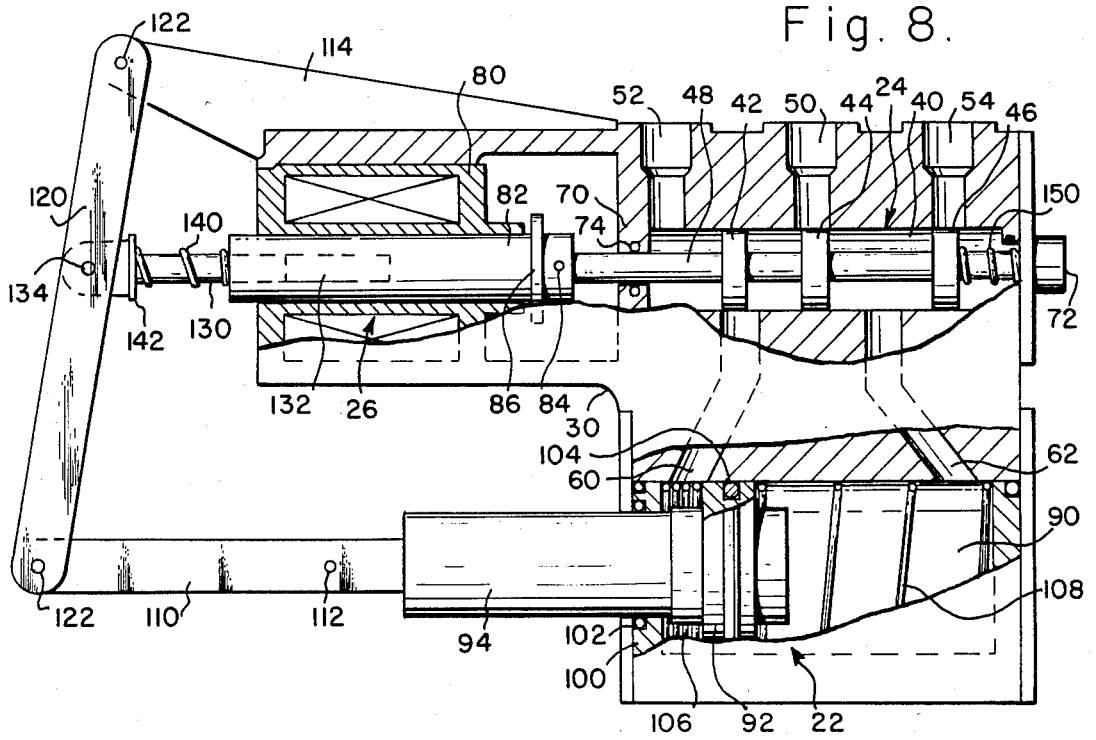
FIG. 8 is a similar view of the device of FIG. 1, at the instant at which the electrical control signal has diminished to a second preselected value.
Figure 9:
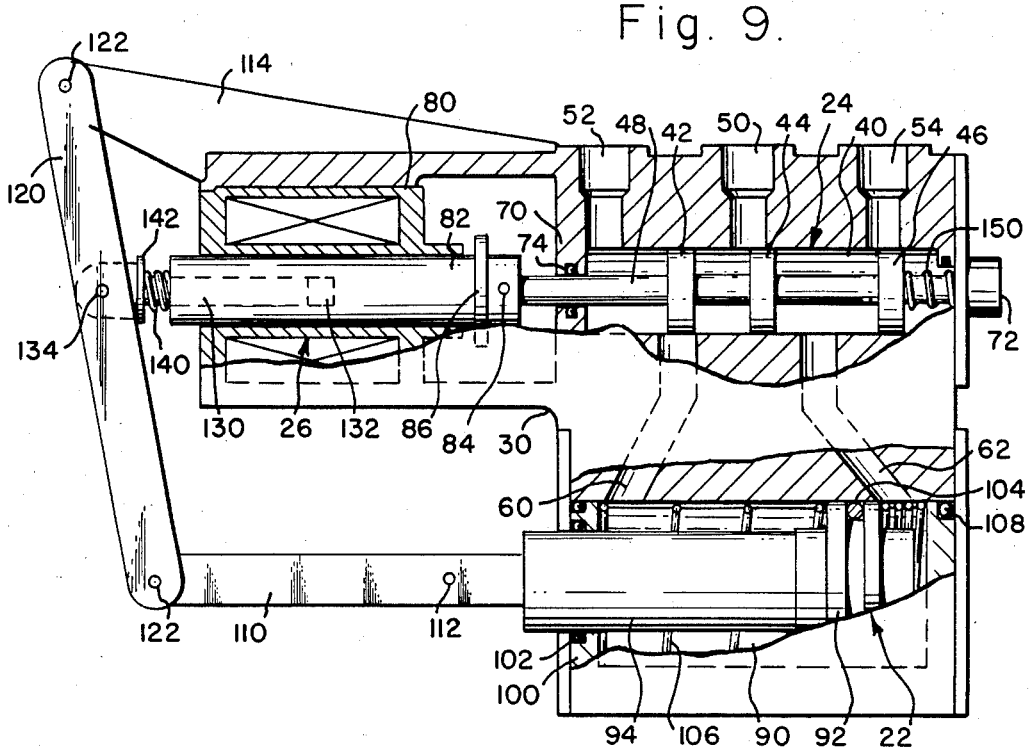
FIG. 9 is a similar view of the device of FIG. 1, after the device has reached an equilibrium point for the electrical control signal supplied in FIG. 8.

When the electrical control signal supplied to the solenoid coil 80 diminishes to the second threshhold value depicted by the point H on the plot in FIG. 10, the instantaneous conditions present in the actuator 20 are as shown in FIG. 8. The fluidic path between the fluid inlet 50 and the minus fluid line 62 is beginning to be obstructed by the inlet valve disc 44, which will cause hydraulic pressure to be present only in the plus fluid line 60. This will cause the piston 92 to toggle again to the full rightward position shown in FIG. 9. As it begins to toggle, the compression spring 140 is further compressed, resulting in the solenoid plunger 82, the spool rod 48, and the valve discs 42, 44, and 46 moving further to the right, to the position depicted by the point I in FIG. 10.

Referring now to FIG. 10, it can be seen that full linear operation of the power turbine nozzles from the zero degree angular position to the full positive angular position may be obtained by varying the electrical control signal from the level depicted at the point B to the level depicted at the point D. Further increases in the electrical control signal from that shown at D to just below that shown at E will result in no further movement of the piston 92. When the electrical control signal reaches the level depicted at the point E, the piston will immediately toggle to the position shown at the point F, which represents the full negative angular position of the power turbine nozzles. When the electrical control signal drops to the level indicated at the point H, the piston 92 will return to the position indicated at the point I, that is, to the full positive angular position of the power turbine nozzles. The loop formed by the letters E, F, H, I is a hysteresis-type loop, and the presence of this loop will prevent rapid and unwanted oscillation of the piston 92.

In the event of an electrical failure, it can be seen from FIG. 10 that the piston 92 will return to the zero degree angular position, corresponding to a zero degree angular position of the power turbine nozzles. In the event of a hydraulic failure, the piston will also return to the zero degree angular position, since it is biased in that position by the springs 106, 108 in the absence of hydraulic pressure on either side of the piston.

Thus, it can be seen that the present invention safeguards against both electrical and hydraulic system failure, and will shut down the power turbine by causing the power turbine nozzles to return to the zero degree angular position in the event of a failure in either the electrical system or the hydraulic system. In addition, the actuator 20 of the present invention includes buit-in toggling action, thus providing improved performance without requiring an additional dump valve to be installed in the system. This decreases the cost, weight, and size of the control system. The present invention therefore possesses a number of significant advantages over previously available control systems, and such advantages are readily apparent to those skilled in the art.

It is to be understood that the above description is given by way of illustration and example only, and is in no way intended to limit the spirit or scope of the present invention as set forth below in the appended claims.

What is claimed is:

1. An electro-hydraulic proportional actuator, comprising:

a housing including a cylinder, said cylinder having ports for admitting hydraulic fluid to said cylinder, at a first port at one end of said cylinder, and at a second port at the other end of said cylinder;

piston means movably installed in said cylinder, said piston means having an output shaft coupled for movement therewith at said one end of said cylinder, said piston means being driven toward said other end of said cylinder when pressurized fluid is admitted through both said first port and said second port;

valve means means for admitting pressurized fluid to said cylinder, said valve means having selectable flow portions in which no fluid is admitted to said cylinder, fluid is admitted only through said first port, or fluid is admitted is admitted through both said first and second ports, said valve means being operable to cause said piston means to be driven to any of an infinite number of positions;

a solenoid coupled to produce a first force to drive said valve means to a selected flow position corresponding to an incremental change in the electrical control signal supplied to said solenoid; and feedback means responsive to the movement of said piston means, for producing a second force opposing said first force, said second force also coupled to drive said valve means; said feedback means comprises:

a lever arm 120 pivotably connected to said housing, said lever arm also being pivotably connected to said output shaft 94 so any movement of said piston means in said cylinder causes a corresponding translation of said lever arm about said housing; and means 130 operably connected to said level arm for transmitting said second force from said level arm to said solenoid;

and wherein said means for transmitting comprises: a spring, one end of said spring being connected to and moving with said lever arm, and other end of said spring being connected to the plunger of said solenoid.

2. An electro-hydraulic proportional actuator, comprising:

a housing;

a double-acting fluid-responsive motive member having an output shaft coupled movement therewith;

valve means for allowing two-directional flow of pressure fluid to drive said motive member, said valve means being movable between multiple flow positions including a position in which said pressurized fluid is not supplied to one side of said motive member, and position in which said pressurized fluid is supplied to both sides of said motive member, said valve means being operable to cause said motive member to be driven to any of an infinite number of positions;

a solenoid coupled to drive and valve means to a selected flow position corresponding to a varied electrical control signal; and feedback means responsive to the movement of said motive member for opposing movement of said valve, means caused by said solenoid;

said feedback means comprises:

a lever arm pivotably connected to said housing, said lever arm also being pivotably connected to said output shaft so any movement of said motive member causes a corresponding translation of said lever arm about said housing; and means operably connected to said lever arm for transmitting said second force from said lever arm to said solenoid; and said means for transmitting comprises:

a spring, one end of said spring being connected to and moving with said lever arm, the other end of said spring being connected to the plunger of said solenoid.

3. An electro-hydraulic proportional actuator, comprising:

a housing;

a hydraulic cylinder having a first port at a first end of said cylinder and a second port at a second end of said cylinder;

a piston slideably installed in said cylinder, said piston having an output shaft coupled thereto, said piston having a first surface area perpendicular to the axis of said cylinder on the side of said piston facing said first end of said cylinder, said piston having a second surface area perpendicular to the axis of said cylinder on the side of said piston facing said second end of said cylinder, said second area being greater than said first area;

spring means for urging said piston into a central position in said cylinder in the absence of pressurized fluid in said cylinder;

a spool valve for selectively admitting pressurized fluid to said first port or said first and second ports, said spool valve being operable to cause said piston to be driven to any of an infinite number of positions;

a solenoid coupled to drive said spool valve to a selected flow position corresponding to the electrical control signal supplied to said solenoid; and feedback means responsive to movement of said piston for opposing movement of said spool valve caused by said solenoid.

4. An electro-hydraulic proportional actuator as defined in claim 3, wherein said solenoid comprises:

a solenoid coil; and a solenoid plunger mechanically coupled to said spool valve, said solenoid plunger being drawn axially into said solenoid coil by a magnetic force proportional to the magnitude of said electrical control signal.

5. An electro-hydraulic proportional actuator as defined in claim 4, further comprising:

spring means for biasing said solenoid plunger away from said solenoid coil, said spring means producing a force opposing said magnetic force.

6. An electro-hydraulic proportional actuator as defined in claim 3, wherein said spring means comprises:

a first spring axially located in said cylinder between said first end of said cylinder and the side of said piston facing said first end of said cylinder, said first spring urging said piston toward said second end of said cylinder; and a second spring axially located in said cylinder between said second end of said cylinder and the side of said piston facing said second end of said cylinder, said second spring urging said piston toward said first end of said cylinder.

7. An electro-hydraulic proportional actuator as defined in claim 6, wherein the forces of each of said first and second springs are insufficient to prevent movement of said piston caused by the presence of pressurized hydraulic fluid in said cylinder.

8. An electro-hydraulic proportional actuator as defined in claim 3, wherein said spool valve comprises:

a spool member translatable along an axis within a valve chamber, said spool member being operatively coupled to said solenoid, said spool member moving axially by a distance proportional to the magnitude of said electrical control signal supplied to said solenoid.

9. An electro-hydraulic proportional actuator as defined in claim 3, further comprising:

seal means mounted on said piston and moving slideably along the inner surface of said cylinder, said seal means preventing the leakage of hydraulic fluid from one side of said piston to the other side of said piston.

10. An electro-hydraulic proportional actuator, comprising:

a housing;

a hydraulic cylinder having a first port at a first end of said cylinder and a second port at a second end of said cylinder;

a piston slideably installed in said cylinder, said piston having an output shaft coupled thereto, said piston having a first surface area perpendicular to the axis of said cylinder on the side of said piston facing said first end of said cylinder on the side of said piston facing said first end of said cylinder, said piston having a second surface area perpendicular to the axis of said cylinder on the side of said piston facing said second end of said cylinder, said second area being greater than said first area;

spring means for urging said piston into a central position in said cylinder in the absence of pressurized fluid in said cylinder;

a spool valve for selectively admitting pressurized fluid to said first port or said first and second port, said spool valve being operable to cause said piston to be driven to any of an infinite number of positions;

a solenoid coupled to drive said spool valve to a selected flow position corresponding to the electrical control signal supplied to said solenoid; and feedback means responsive to movement of said piston for opposing movement of said spool valve caused by said solenoid;

wherein said feedback means comprises:

a lever arm pivotably connected to said housing, said lever arm also being pivotably connected to said output shaft so any movement of said piston in said cylinder causes a corresponding translation of said lever arm about said housing; and a spring, one end of said spring being connected to and moving with said lever arm, the other end of said spring being connected to the plunger of said solenoid.

11. An electro-hydraulic proportional actuator, comprising:

a housing;

a hydraulic cylinder having a first port at a first end of said cylinder and a second port at a second end of said cylinder;

a piston slideably installed in said cylinder, said piston having an output shaft coupled thereto, said piston having a first surface area perpendicular to the axis of said cylinder on the side of said piston facing said first end of said cylinder, said piston having a second surface area perpendicular to the axis of said cylinder on the side of said piston facing said second end of said cylinder, said second area being greater than said first area;

a spool valve for selectively admitting pressurized fluid to said first port or said first and second ports, said spool valve being operable to cause said piston to be driven to any of an infinite number of pistons;

a solenoid coupled to drive said spool valve to a selected flow position corresponding to the electrical control signal supplied to said solenoid;

spring means for biasing said spool valve in a position allowing no pressurized fluid to be supplied to said cylinder in the absence of an electrical control signal being supplied to said solenoid; and feedback means responsive to movement of said piston for opposing movement of said spool valve caused by said solenoid.

12. An electro-hydraulic proportional actuator as defined in claim 11, wherein said solenoid comprises:

a solenoid coil; and a solenoid plunger mechanically coupled to said spool valve, said solenoid plunger being drawn axially into said solenoid coil by a force proportional to the magnitude of said electrical control signal.

13. An electro-hydraulic proportional actuator as defined in claim 11, further comprising:

means for biasing said piston in a central position in said cylinder in the absence of pressurized fluid in said cylinder.

14. An electro-hydraulic proportional actuator as defined in claim 13, wherein said biasing means comprises:

a first spring axially located in said cylinder between said first end of said cylinder and the side of said piston facing said first end of said cylinder, said first spring urging said piston toward said second end of said cylinder; and a second spring axially located in said cylinder between said second end of said cylinder and the side of said piston facing said second end of said cylinder, said second spring urging said piston toward said first end of said cylinder.

* * * * *